US007471038B2

(12) United States Patent
Kuniyasu et al.

(10) Patent No.: US 7,471,038 B2
(45) Date of Patent: Dec. 30, 2008

(54) IMAGE DISPLAY DEVICE

(75) Inventors: Tsutomu Kuniyasu, Mobara (JP); Go Saitou, Mobara (JP); Terunobu Satou, Yokote (JP); Tomoki Nakamura, Chiba (JP)

(73) Assignee: Hitachi Displays, Ltd., Mobara-shi (JP)

( * ) Notice: Subject to any disclaimer, the term of this patent is extended or adjusted under 35 U.S.C. 154(b) by 260 days.

(21) Appl. No.: 11/598,655

(22) Filed: Nov. 14, 2006

(65) Prior Publication Data

US 2007/0114912 A1 May 24, 2007

(30) Foreign Application Priority Data

Nov. 14, 2005 (JP) ..... 2005-328543

(51) Int. Cl.
*H01J 1/62* (2006.01)

(52) U.S. Cl. ..... 313/495

(58) Field of Classification Search ..... 313/495, 313/257, 292

See application file for complete search history.

(56) References Cited

U.S. PATENT DOCUMENTS 4,451,761 A * 5/1984 Kay ..... 313/586
5,770,918 A * 6/1998 Kawate et al. ..... 313/495

* cited by examiner

*Primary Examiner*—Vip Patel
(74) *Attorney, Agent, or Firm*—Antonelli, Terry, Stout & Kraus, LLP.

(57) ABSTRACT

An image display device is disclosed in which poor display resulting from deflection of electron bundles which occurs due to electrification of spacers and secondary electron emission can be positively prevented and a high-quality display can be therefore obtained. In the image display device, electron sources in the vicinity of the spacers are displaced with respect to arranging positions at equal pitches, by distances which allow drifts of the electron bundles from phosphors, which are brought about by the deflection of the electron bundles which occurs due to electrification of the spacers and secondary electron emission, to be cancelled.

5 Claims, 7 Drawing Sheets

IMAGE DISPLAY DEVICE

CLAIM OF PRIORITY

The present application claims priority from Japanese Application JP 2005-328543 filed on Nov. 14, 2005, the content of which is hereby incorporated by reference into this application.

BACKGROUND OF THE INVENTION

1. Field of the Invention

The present invention relates to a spontaneous light-emissive flat panel-type image display device and, more particularly, to a panel structure suitable for an image display device having a rear panel which comprises a substrate having a main surface and thin film type-electron sources disposed in the form of a matrix on the main surface of the substrate.

2. Description of the Related Art

As one example of spontaneous light-emissive flat panel-type display devices having electron sources two-dimensionally arranged in the form of a matrix, there is known a display device which employs an electron-emissive flat panel utilizing a cold cathode which is micro and can be integrated. As the cold cathode which is one of elements constituting the electron-emissive flat panel, there is known a thin film electron source such as a spint-type electron source, a surface conductive-type electron source, a carbon nano tube type electron source, an MIM (Metal Insulator Metal) type electron source in which a layer of metal, a layer of an insulator and a layer of metal are stacked, an MIS (Metal-Insulator-Semiconductor)-type electron source in which a layer of metal, a layer of an insulator and a layer of a semiconductor are stacked, and a metal-insulator-semiconductor-metal type electron source.

A driver circuit and the like are combined with the panel provided with such electron sources, to thereby form an image display device.

FIG. 1 is a schematic view which is of assistance in explaining a display principal for one pixel in a display panel which is one of elements constituting an image display device which employs MIM-type electron sources. This display panel includes a rear panel PNL1 and a front panel PNL2. The rear panel PNL1 and the front panel PNL2 are hermetically combined with each other by a closure frame not shown, whereby an internal space of the display panel is kept in an evacuated condition. The rear panel PNL1 includes a rear substrate SUB1 having a main surface and formed from, for example, a glass substrate or the like, an image signal wire d (a so-called data wire) provided on the main surface of the rear substrate SUB1 and constituting a lower electrode for an electron source, the image signal wire d being suitably formed of an aluminum (Al) film, a first insulating film INS1 formed of an anode oxidation film formed by causing the aluminum of the lower electrode to be anode-oxidized, a second insulating film INS2 suitably formed of a silicon nitride (SiN) film, an electric supply electrode (connection electrode) ELC, a scan signal wire s suitably formed of aluminum (Al), and an upper electrode AED connected to the scan signal wire s and being one of elements constituting the electron source for the pixel.

The electron source ELS utilizes the image signal wire d as the lower electrode and includes a thin film portion INS3 constituting a part of the first insulating film INS1 disposed on the lower electrode and a portion constituting a part of the upper electrode AED disposed on the thin film portion INS3.

The upper electrode AED is formed so as to cover the scan signal wire s and a part of the electric supply electrode ELC. The thin film portion INS3 is a so-called tunnel film. By this structure, a so-called diode electron source is formed.

On the other hand, the front panel PNL2 includes a front substrate SUB2 having a main surface and suitably formed from a transparent glass substrate, a shading film (hereinafter referred to as "black matrix") BM disposed on the main surface of the front substrate SUB2, a phosphor PH separated from adjacent pixels by the shading film BM, and an anode AD suitably formed of an aluminum deposition film.

A spacing between the rear panel PNL1 and the front panel PNL2 is approximately 3-5 mm and is kept constant by a spacer SPC called a bulkhead. The thicknesses of the rear substrate SUB1 and the front substrate SUB2 are about 2.8 mm, for example. The height of the spacer is about 3 mm, for example. Spacer SPC are provided for every scan signal wires s so as to continuously or discontinuously stand up from the scan signal wires s. While the thicknesses of the respective layers are shown in FIG. 1 so as to be emphasized for clarity, the thickness of the film constituting the scan signal wire s is about 3 μm, for example.

In the image display panel constructed as discussed above, when accelerating voltage V (about 2 kV to 10 kV, and about 5 kV in the illustrated example) is applied between the upper electrode AED of the rear panel PNL1 and the anode AD of the front panel PNL2, a bundle EB of electrons $e^-$ (electron bundle or electron beam) corresponding to the magnitude of display data supplied to the image signal wire d which is the lower electrode is emitted. The electron bundle EB is bombarded against the phosphor PH by the accelerating voltage V and excites the phosphor PH, whereby the phosphor PH emits light L of a predetermined frequency out of the front panel PNL2. Incidentally, when full-color display is to be performed, this unit pixel is a sub-pixel for color and one color pixel is typically comprised of three sub-pixels, i.e., a red (R) sub-pixel, a green (G) sub-pixel and a blue sub-pixel.

The spacer SPC is formed from a thin plate of glass or ceramics. Therefore, the spacer which is arranged in the vicinity of the electron source ELS is charged by parts of the electrons emitted from the electron source and emits secondary electrons, whereby the electron bundle EB is deflected as indicated in FIG. 1 by arrows D. The magnitude of this deflection becomes larger the more the electron source is close to the spacer. Moreover, electron bundles emitted from electron sources which are arranged in the vicinity of an end portion SEG of the spacer (see FIG. 2) are deflected in such directions as to take the shortest distance with respect to the end portion SEG.

FIG. 2 is a schematic layout of phosphors on the main surface of the front substrate, which is of assistance in explaining variations in landing of electron bundles from electron sources on the phosphors which occur due to the deflection of the electron bundles which is brought about by the spacer. FIG. 3 is a schematic sectional view of the display panel including the rear substrate, taken along the line B-B' in FIG. 2. The front substrate SUB2 has the black matrix BM disposed on the main surface thereof and the phosphors PH (red, green and blue phosphors R, G, B) applied into openings of the black matrix BM. Incidentally, the anode AD shown in FIG. 1 has been left out of the illustration. The spacer SPC is arranged along the unshown scan signal wire. The openings of the black matrix into which the phosphors PH are applied (the openings are filled with the phosphors, so that a relationship between the openings and the phosphors is represented as the openings=phosphors PH) are disposed at equal pitches in a longitudinal direction X of the spacer and in a direction Y perpendicular to the longitudinal direction X. FIG. 3 also illustrates that electron sources ELS provided on the rear substrate SUB1 are arranged at equal pitches PV in the direction Y.

Of the electron bundles EB which are emitted from the electron sources ELS provided on the rear substrate SUB1 and indicated in FIGS. 2 and 3 by broken lines, electron bundles emitted from electron sources which are arranged adjacent the spacer SPC are particularly greatly affected by the electrification of the spacer SPC. In FIG. 2, deflection directions of the electron bundles EB and the magnitude of the deflection are illustrated by thick arrows. Incidentally, as shown in FIGS. 2 and 3, the spacer SPC is arranged so as to extend in the longitudinal direction X at a center portion between two lines of electron sources ELS which are arranged on the left hand side of the sheets of these Figures, and a spacer is not arranged in the right direction or in the direction Y in which two or more lines of electron sources ELS shall be arranged.

Of the electron bundles EB which are emitted from the electron sources ELS and shown in the shape of a rectangle in FIG. 2 by broken lines, the more electron bundles are close to the spacer, the deflection amounts of the electron bundles become large. Such electron bundles are shifted relative to corresponding openings of the black matrix, namely, corresponding phosphors PH. As a result, regions which are not excited by the electron bundles (do not emit light) are produced in the corresponding phosphors, thus presenting on a screen black stripes extending the longitudinal direction X of the spacer. This results in considerable deterioration of a display quality and leads to an irregularity in the brightness of the screen.

SUMMARY OF THE INVENTION

The present invention has been made with a view to overcoming the foregoing problems of the prior art image display device.

It is therefore an object of the present invention to provide an image display device that can prevent poor display which results from deflection of electron bundles which is brought by electrification of a spacer and/or secondary electron emission, and that ensures a high-quality display.

In accordance with the present invention, there is provided an image display device in which, in order to cancel the effect of deflection of trajectories of electron bundles which occurs due to electrification of a spacer by electrons emitted from electron sources and secondary electron emission, the electron sources and/or phosphors (openings of a black matrix) are displaced from equal-pitch arranging positions. That is, electron sources arranged in the vicinity of the spacer, and/or corresponding phosphors are displaced to positions which allow electron bundles emitted from the electron sources to be bombarded against centers of the corresponding phosphors and cover the entire phosphors at the time of electric current bringing about the maximum deflection of trajectories the electron bundles.

The above-mentioned structure of the image display panel according to the present invention makes it possible to prevent failures in landing of the electron bundles from the electron sources on the phosphors corresponding to the electron sources which are arranged in the vicinity of the spacer, and makes it possible to provide a high-quality display in which black stripes are not produced and an irregularity in the brightness is not remarkable.

The object, other objects and many of the attendant advantages of the present invention will be readily appreciated as the same becomes better understood by reference to the following detailed description when considered in connection with the accompanying drawings.

DETAILED DESCRIPTION OF THE INVENTION

Embodiments according to the present invention will be discussed hereinafter with reference to the accompanying drawings.

FIRST EMBODIMENT

Figure 1:
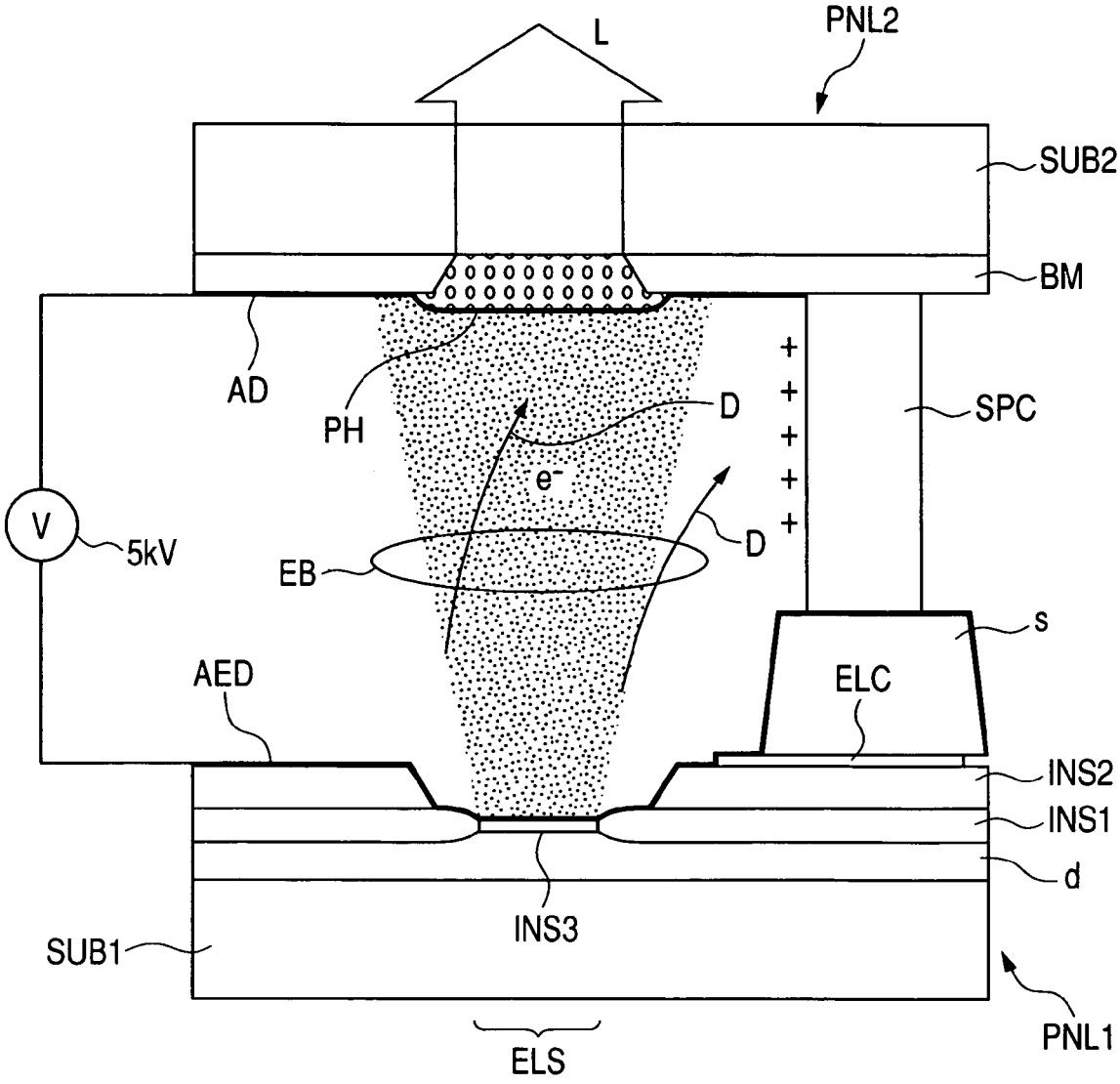
FIG. 1 is a schematic view which is of assistance in explaining the display principle of a panel for one pixel, which is one of members constituting an image display device employing MIM-type electron sources.
Figure 2:
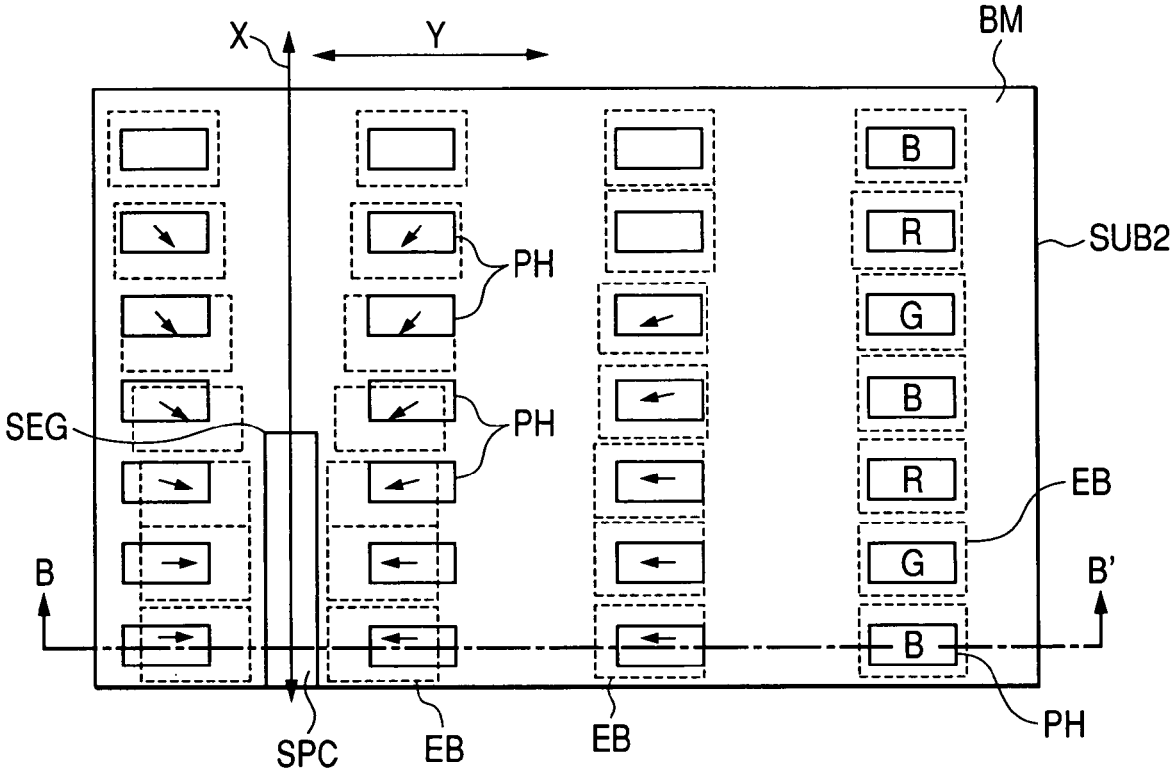
FIG. 2 is a schematic layout of phosphors on a main surface of a front substrate, which is of assistance in explaining variations in landing of electron bundles from the electron sources on the phosphors which occur due to deflection of the electron bundles which is brought about by a spacer.
Figure 3:
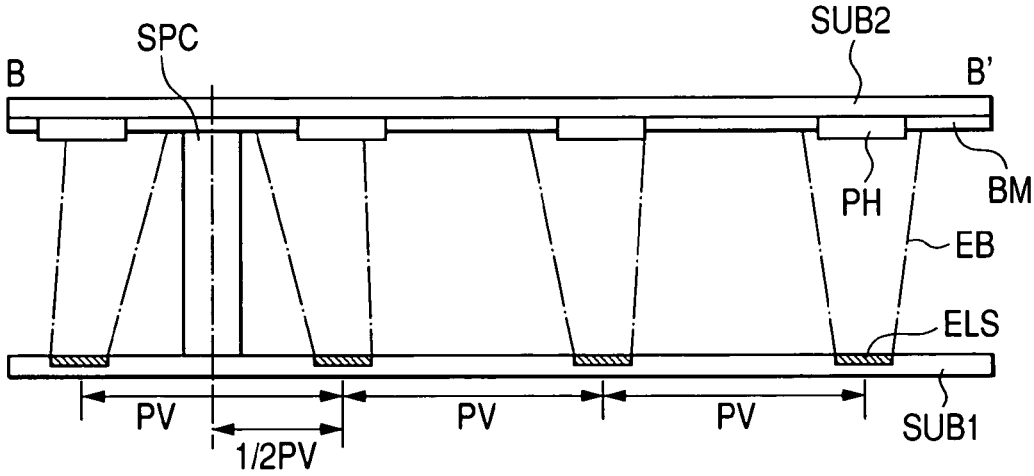
FIG. 3 is a schematic sectional view of the panel including a rear substrate, taken along the line B-B' in FIG. 2.
Figure 4:
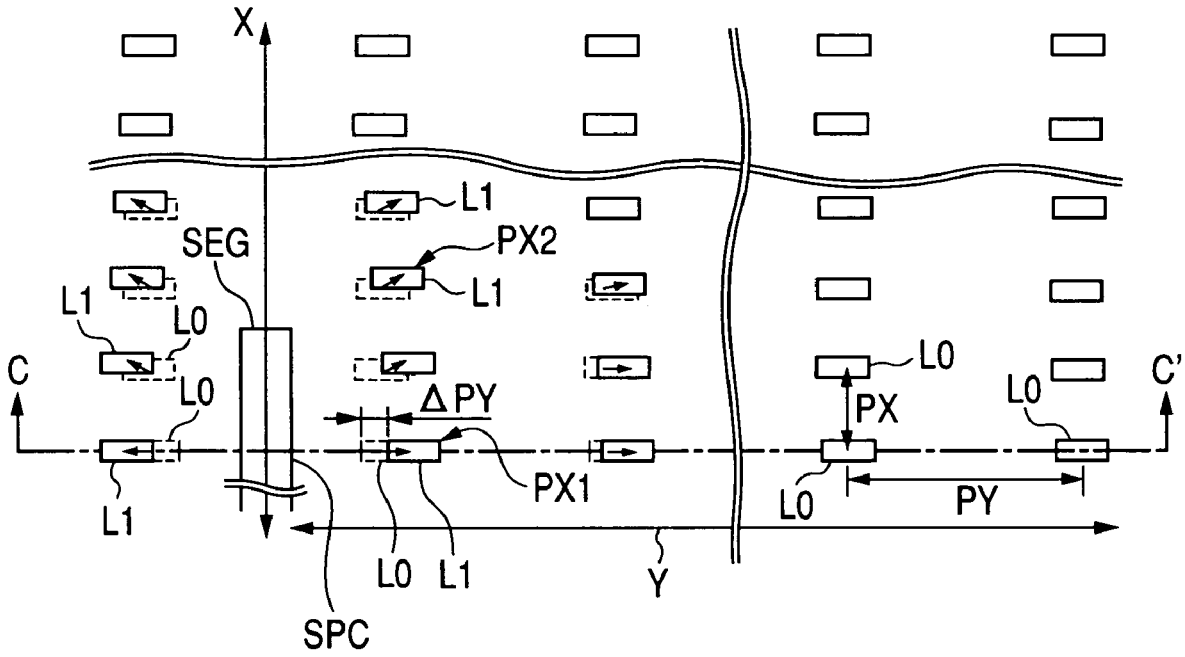
FIG. 4 is a schematic layout of phosphors on a main surface of a front substrate similar to the front substrate shown in FIG. 2, which is of assistance in explaining a first embodiment of the present invention.
Figure 5:
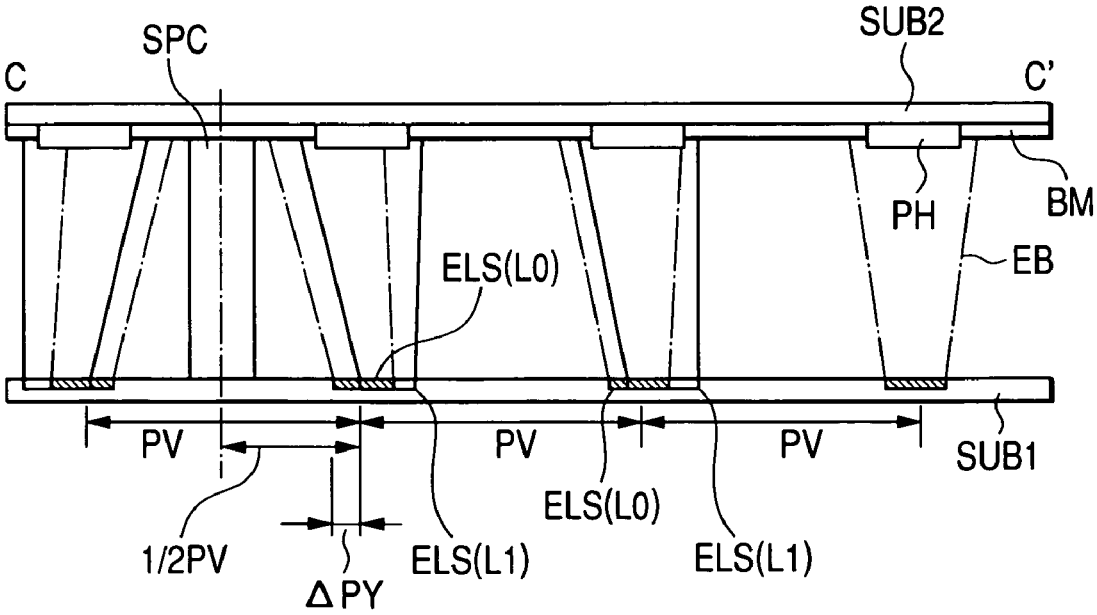
FIG. 5 is a schematic sectional view which is taken along the line C-C' in FIG. 4 and similar to FIG. 3.

FIG. 4 is a schematic layout of phosphors on a main surface of a front substrate, which is similar to FIG. 2 and of assistance in explaining a first embodiment of the present invention. Moreover, FIG. 5 is a schematic sectional view taken along the line C-C' in FIG. 4, which is similar to FIG. 3. In FIG. 4, rectangular shapes which are shown by broken lines and denoted by a designator LO represent hypothetical positions of electron sources hypothetically disposed at equal horizontal-pitches PX in a longitudinal direction X of a spacer SPC and at equal vertical-pitches PY in a direction Y perpendicular to the longitudinal direction X. Rectangular shapes which are indicated by solid lines and denoted by a designator L1 represent positions of the electron sources displaced in such a manner that electron bundles emitted from the electron sources can cover entire regions of phosphors at central portions of openings of a black matrix BM (central portions of the phosphors) at the time of a maximum current.

Moreover, thick arrows shown in FIG. 4 represent displacement directions of the electron sources and the magnitude of the displacement which are adjusted in such a manner that the displacement directions and the magnitude of the displacement cancel the deflection directions of the electron bundles in FIG. 2 and the magnitude of the deflection, respectively.

The first embodiment is discussed with respect to, for example, an electron source PX1. In this embodiment, a deflection direction of an electron bundle EB emitted from the electron source PX1, in which the electron bundle EB is drawn to the spacer SPC, is parallel to the direction Y, so that the electron source PX1 is displaced so as to be away from the spacer SPC by a distance ΔPY in the direction Y. The magnitude of this displacement corresponds to a magnitude which is obtained by canceling a amount of deflection of the electron bundle which occurs due to the electrification of the spacer and the second electron emission which have been discussed with reference to FIG. 2, and allows the electron buddle to be bombarded against a central portion of the corresponding phosphor and cover the corresponding phosphor. Moreover, an electron source PX2 in the vicinity of an end portion SEG of the spacer is arranged at a position displaced in the directions X and Y.

FIG. 5 is a schematic sectional view of a portion of a panel including the electron source PX1 shown in FIG. 4, taken along the Y direction, in which electron sources ELS (LO) are arranged at equal pitches and electron sources ELS (L1) are arranged so as to be displaced from equal pitch arranging positions by the above-mentioned distance ΔPY.

Incidentally, in the illustrated embodiment, the electron source PX1 is displaced by the distance ΔPY in such a direction as to be away from the spacer SPC and the positions of the electron sources themselves are shifted from the ELS (LO) to the ELS (L1), so that the electron sources are not arranged at dash-lined portions LO. However, the present invention is limited to such a structure and an area of an electron source may be increased by causing a center of the entire electron source to be displaced by the distance ΔPY in such a direction as to be away from the spacer SPC in a state in which the electron source is arranged at the dash-lined portion LO, and by forming a shape in which the shape of the dash-lined portion LO and the shape of the solid-lined portion L1 are combined with each other. Such a structure allows an electron beam to normally land on a corresponding phosphor even if a current value of the electron beam varies.

Figure 6:
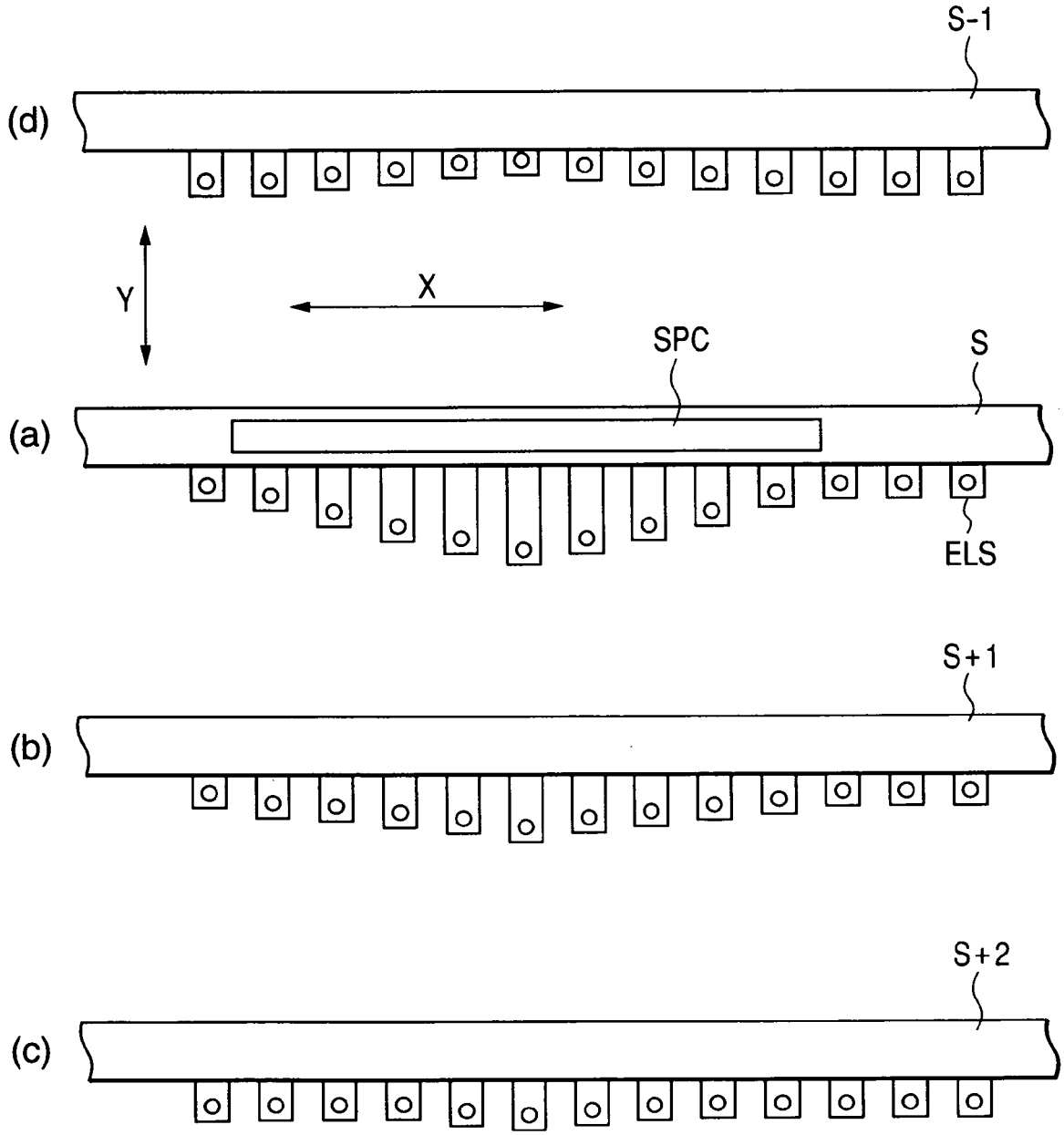
FIGS. 6A, 6B, 6C, and 6D are schematic views which are of assistance in explaining examples of a displaced arrangement of electron sources in the first embodiment.

FIGS. 6A, 6B, 6C, and 6D are schematic views which are of assistance in explaining examples of a displaced arrangement of the electron sources in the first embodiment. In an illustrated example shown in FIG. 6A, the spacer is provided on a scan signal wire s so as to stand up from the scan signal wire s. Of several electron sources ELS to be selected in the scan signal wire s, electron sources which are arranged in the vicinity of the spacer SPC are most easily affected by the electrification of the spacer SPC. The degree of the effect is largest at a central portion of the spacer SPC and becomes gradually smaller according to approaching both end portions of the spacer. The electron sources ELS are arranged in the form of a wave as shown in FIG. 6A, in such a manner that a distance of an electron source at the central portion of the spacer from the spacer is greatest so as to allow the magnitude of the effect to be canceled, and the remaining electron sources are gradually returned to the equal pitch positions according to approaching the both end portions of the spacer.

Several electron sources ELS to be selected in a scan signal wire s+1 on which a spacer is not disposed and which is to be arranged in parallel and next to the scan signal wire s on which the spacer SPC is arranged, are arranged in the form of a wave as shown in FIG. 6B, in such a manner that a displacement amount of the electron sources is smaller than the displacement amount of the electron sources to be selected in the scan signal wire s. Electron sources to be selected in a scan signal wire s+2 which is to be arranged next to the scan signal wire s+1 are arranged with a smaller amount of displacement as shown in FIG. 6C.

Incidentally, as shown in FIG. 6D, electron sources to be selected in a scan signal wire s−1 which is to be arranged at an end opposed to the scan signal wire s+1 with respect to the scan signal wire s are arranged in the form of a wave reverse to the waveform of the several electron sources ELS to be selected in the scan signal wire s, in such a manner that a distance of an electron source at the central portion of the spacer from the spacer is greatest (a location close to the scan signal wire s−1) and the remaining electron sources are gradually returned to the equal pitch positions according to approaching the both end portions of the spacer.

The first embodiment makes it possible to prevent failures in landing of electron bundles from electron sources on phosphors corresponding to the electron sources which are arranged in the vicinity of the spacer, and makes it possible to provide a high-quality display in which black stripes are not produced and an irregularity in the brightness is not remarkable.

SECOND EMBODIMENT

Figure 7:
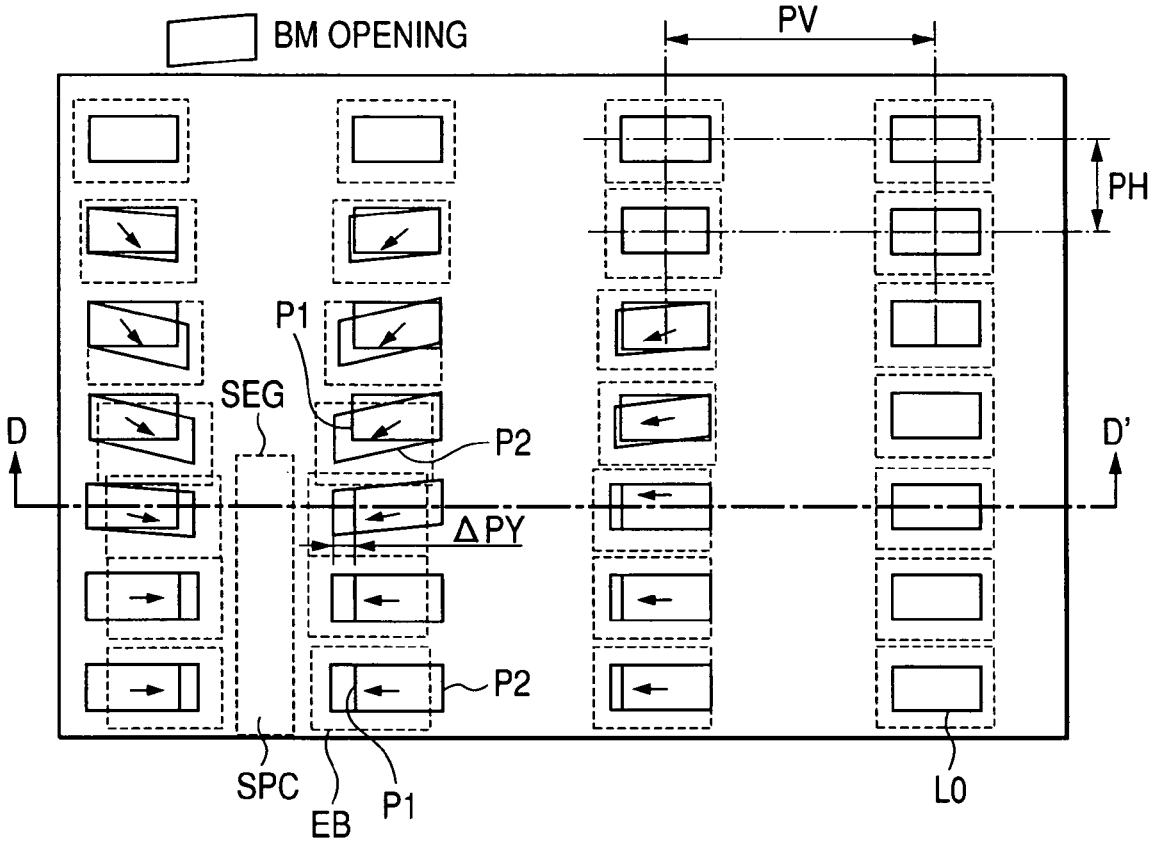
FIG. 7 is a schematic layout of phosphors on a main surface of a front substrate, which is of assistance in explaining a second embodiment according to the present invention.
Figure 8:
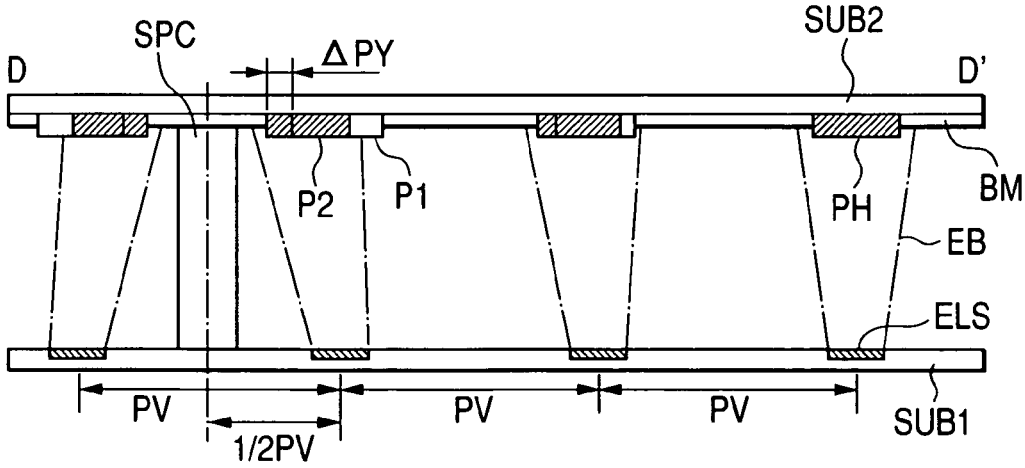
FIG. 8 is a schematic sectional view taken along the line D-D' in FIG. 7.

FIG. 7 is a schematic layout of phosphors on the main surface of the front substrate, which is of assistance in explaining a second embodiment according to the present invention. FIG. 8 is a schematic sectional view taken along the line D-D' in FIG. 7. In the second embodiment, the positions of the phosphors PH are displaced toward the spacer SPC by distances corresponding to deviations of the electron bundles EB with respect to the phosphors PH (the openings of the black matrix), which occur due to deflection of the electron bundles which is brought about due to the electrification of the spacer SPC and the secondary electron emission.

The electron bundles emitted from the electron sources ELS are deflected in such a direction as to be indicated by thick arrows in FIG. 7, due to the electrification of the spacer SPC and the secondary electron emission. In FIG. 7, the thick arrows are different in length from one another and the differences in the lengths of the arrows represent the magnitude of the deflection. In FIGS.7 and 8, a designator P1 denotes the openings (phosphors) of the black matrix which are arranged at equal pitches, and a designator P2 denotes the openings of the black matrix which are displaced. Moreover, broken lines represent the electron bundles at the time of a current value which brings about the maximum deflection of trajectories of the electron bundles (the broken lines in FIG. 7 represent the landing positions of the electron bundles and the broken lines in FIG. 8 represent the emission direction of the electron bundles). As shown in FIG. 8, in the second embodiment, the openings of the black matrix are displaced to the positions indicated by the designator P2, by distances corresponding to drifts of the landing positions of the electron bundles which are brought about by the electrification of the spacer SPC and the secondary electron emission. Incidentally, the openings of the black matrix are preferably displaced in such a manner that portions of the openings which are adjacent the spacer extends as shown in FIGS. 7 and 8.

Of the openings of the black matrix, openings which are arranged in the vicinity of the end portion SEG of the spacer SPC are each preferably formed into a parallelogrammatic shape according to the directions of the arrows. When electron bundles land on corresponding openings, even if parts of the openings jut out of the electron bundles, there is no problems as far as areas of the phosphors excited by the electron bundles are equal to those of the openings P1.

In the second embodiment, failures in landing of electron bundles emitted from electron sources arranged in the vicinity of the spacer onto corresponding phosphors can be also prevented, so that black stripes are not produced on a screen and it is possible to ensure a high-quality display without a remarkable irregularity in the brightness of the screen.

Incidentally, even if the structure of the first embodiment and the structure of the second embodiment are combined with each other, the same effects can be also obtained. In short, as far as deviations (deflection directions of the electron bundles and the magnitude of the deflection) between centers of electron sources and centers of openings corresponding to the electron sources are designed such that the deflection directions of the electron beams and the magnitude of the deflection can be compensated, there are no problems.

Figure 9:
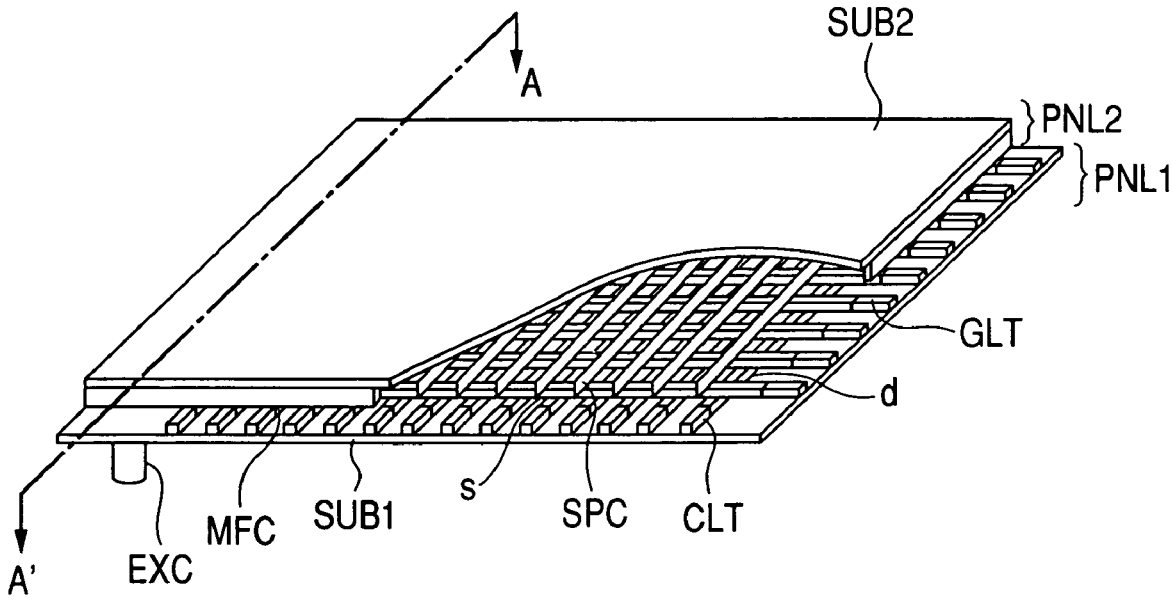
FIG. 9 is a schematic partially cutaway perspective view which is of assistance in explaining one example of an entire structure of the image display device according to the present invention.
Figure 10:
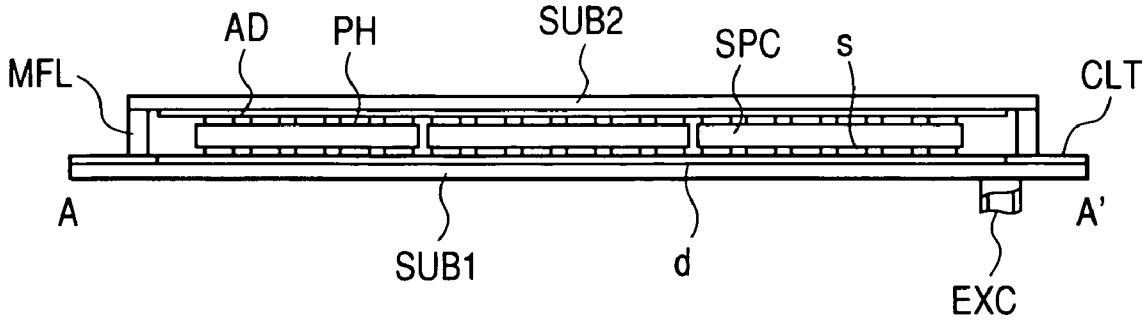
FIG. 10 is a schematic sectional view taken along the line A-A' in FIG. 9.

FIG. 9 is a schematic partially cutaway perspective view which is of assistance in explaining an example of the entire structure of the image display device according to the present invention. Moreover, FIG. 10 is a schematic sectional view taken along the line A-A' in FIG. 9. This image display device is an image display device employing MIM-type electron sources. In the illustrated example, a rear substrate SUB1 has data signal wires d and scan signal wires s which are provided on a main surface of the rear substrate SUB1 so as to cross each other, and the electron sources are provided at intersections of the signal wires d, s, whereby a rear panel PNL1 is formed as a whole. At end portions of the data signal wires d, lead-out wires CLT for the data signal wires d are provided. Moreover, at end portions of the scan signal wires s, lead-out wires GLT for the scan signal wires s are provided. The lead-out wires CLT for the data signal wires d are electrically connected to a driver circuit (data driver) for the data signal wires d. Moreover, the lead-out wires GLT for the scan signal wires s are electrically connected to a driver circuit (scan driver) for the scan signal wires s.

A rear substrate SUB2 is provided on a main surface thereof with an anode AD (positive electrode), a black matrix having openings, and phosphors PH applied into the openings, whereby a front panel PNL2 is formed as a whole. The rear substrate SUB1 and the front substrate SUB2 are combined with each other via a closure frame MFL which is provided around peripheries of the rear substrate SUB1 and the front substrate SUB2. In order to maintain a distance between the rear substrate SUB1 and the front substrate SUB2 which are combined with each other, at a predetermined value, spacers SPC which are each suitably formed from a glass plate are provided so as to vertically stand. FIG. 10 is a schematic sectional view taken along the spacers SPC. In the illustrated example, three spacers SPC are disposed on a scan signal wire s. Incidentally, while FIG. 9 illustrates the spacers which are disposed on all of the scan signal wires s, a spacer is, in fact, disposed every several scan signal wires s.

Incidentally, an internal space which is hermetically defined by the rear panel PNL1, the front panel PNL2, and the closure frame MFL is evacuated via an exhaust pipe EXC which is provided at a portion of the rear panel PNL1, whereby the internal space is maintained in a predetermined vacuum state.

Figure 11:
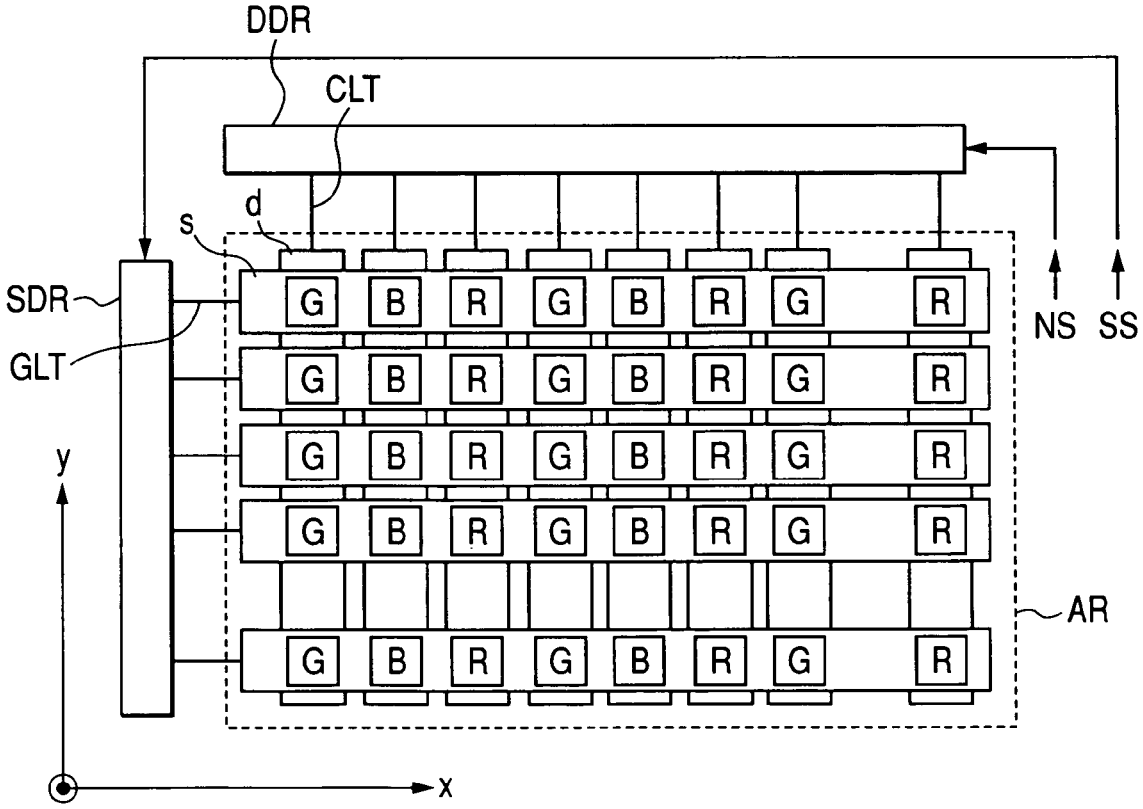
FIG. 11 is a schematic view which is of assistance in explaining one example of an equivalent circuit for the image display device according to the present invention.

FIG. 11 is a schematic view which is of assistance in explaining an example of an equivalent circuit for the image display device to which the structure according to the present invention is applied. In FIG. 11, a region indicated by broken lines is a display region AR. At this display region AR, n pieces of data signal wires d and m pieces of scan signal wires s are arranged so as to cross each other, thereby forming a matrix of n×m. Each intersection in the matrix constitutes sub-pixels for colors and, more particularly, constitutes three unit pixels in FIG. 11, or sub-pixels (one color pixel is comprised of a group of "R", "G", and "B"). Incidentally, the electron sources and the spacers have been left out of the illustration in FIG. 11. The data signal wires d are electrically connected to the data driver DDR by the lead-out terminals CLT of the data signal wires. The scan signal wires s are electrically connected to the scan driver SDR by the lead-out terminals GLT of the scan signal wires. A display signal NS is inputted to the data driver DDR from an external signal source. A scan signal SS is inputted to the scan driver SDR from an external signal source.

Thus, the display signal (image signal or the like) is supplied to data signal wires d which intersect scan signal wires s to be selected in turn, thus enabling a two-dimensional full-color image to be displayed. By employing the above-mentioned structure, a high-quality image display device can be realized.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An image display device comprising:

a rear panel including a rear substrate having a first main surface, and a plurality of electron sources two-dimensionally arranged on the first main surface of the rear substrate for emitting electron bundles;

a front panel including a front substrate having a second main surface, a shading film disposed on the second main surface and having openings corresponding in number to the electron sources, phosphors arranged within the openings, and an anode for accelerating the electron bundles emitted from the electron sources and causing the electron bundles to be bombarded onto the phosphors;

spacers for regulating a spacing between the rear panel and the front panel; and a closure frame provided around peripheries of the front panel and the rear panel for causing the front panel and the rear panel to be combined in a face-to-face relation with each other with a predetermined spacing being left between the front panel and the rear panel, and causing an internal space defined by the front panel, the rear panel and the closure frame to be maintained in an evacuated condition;

the rear panel including a plurality of scan signal wires to which scan signals are adapted to be applied in turn, the scan signal wires extending in a first direction and arranged side by side in a second direction perpendicular to the first direction, a plurality of image signal wires extending in the second direction and arranged side by side in the first direction so as to intersect the scan signal wires, and an electric supply electrode connected to the scan signal wires for supplying electrical current to the electron sources;

the scan signal wires, the image signal wires, and the electric supply electrode being provided on the rear substrate;

the electron sources being provided at intersections of the scan signal wires and the image signal wires;

the spacers each having a first end and a second end and being arranged on any of the scan signal wires so as extend along the scan signal wires; and the spacers being fixed at first ends thereof to any of the scan signal wires and fixed at second ends thereof to the front panel, so that the spacers are disposed between the front panel and the rear panel;

wherein centers of electron sources arranged in the vicinity of the spacers and centers of corresponding openings of the shading film are displaced relative to each other so as to allow compensation of deviations of electron bundles emitted from the electron sources in the vicinity of the spacers with respect to the corresponding openings which occur due to deflection of trajectories of the electron bundles.

2. An image display device according to claim 1, wherein the openings of the shading film are disposed at equal pitches in horizontal and vertical directions on the second main surface of the front substrate, and the electron sources are displaced at positions which, at the time of electrical current bringing about maximum deflection of trajectories of the electron bundles from the electron sources, allow the electron bundles to be bombarded against the centers of the openings of the shading film disposed on the second main surface of the front substrate and cover the openings.

3. An image display device according to claim 1, wherein the electron sources are disposed at equal pitches in horizontal and vertical directions on the first main surface of the rear substrate, and the openings of the shading film are displaced at positions which, at the time of electrical current bringing about maximum deflection of trajectories of the electron bundles from the electron sources, allow the electron bundles to be bombarded against the centers of the openings of the shading film.

4. An image display device according to claim 3, wherein the openings of the shading film are displaced in such directions as to include deflection directions of the electron bundles emitted from the electron sources at the time of the electrical current bringing about the maximum deflection of the trajectories of the electron bundles.

5. An image display device according to claim 1, wherein the electron sources and the openings of the shading film are displaced from equal-pitch arranging positions in horizontal and vertical directions in such a manner that the electron bundles emitted from the electron sources at the time of electrical current bringing about maximum deflection of trajectories deflection of the electron bundles can be bombarded against centers of the openings of the shading film and cover the openings.

* * * * *